US007967584B2

(12) United States Patent
Wang

(10) Patent No.: US 7,967,584 B2
(45) Date of Patent: Jun. 28, 2011

(54) SCROLL MACHINE USING FLOATING SEAL WITH BACKER

(75) Inventor: Zhichao Wang, Vandalia, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1009 days.

(21) Appl. No.: 11/389,652

(22) Filed: Mar. 24, 2006

(65) Prior Publication Data

US 2007/0224071 A1 Sep. 27, 2007

(51) Int. Cl.
*F03C 4/00* (2006.01)
*F04C 18/00* (2006.01)

(52) U.S. Cl. ..... 418/55.4; 418/55.1; 418/55.5; 418/57; 277/648

(58) Field of Classification Search ..... 418/55.1–55.6, 418/57, 112; 277/648
See application file for complete search history.

(56) References Cited

U.S. PATENT DOCUMENTS 4,877,382 A * 10/1989 Caillat et al. ..... 418/55.5
5,064,356 A * 11/1991 Horn ..... 418/55.6
5,156,539 A 10/1992 Anderson et al.
5,320,506 A * 6/1994 Fogt ..... 418/55.5
5,407,335 A * 4/1995 Caillat et al. ..... 418/55.5
5,494,422 A * 2/1996 Ukai et al. ..... 418/55.1
RE35,216 E 4/1996 Anderson et al.
5,800,141 A 9/1998 Ceylan et al.
6,293,767 B1 * 9/2001 Bass ..... 418/55.5
6,419,457 B1 7/2002 Seibel et al.
6,679,683 B2 1/2004 Seibel et al.
2006/0198748 A1 * 9/2006 Grassbaugh et al. ..... 418/55.5

FOREIGN PATENT DOCUMENTS

JP 05149269 A * 6/1993

OTHER PUBLICATIONS

PCT International Search Report dated Aug. 17, 2007 re: PCT/US2007/007011.
Written Opinion of the International Searching Authority dated Aug. 17, 2007.

* cited by examiner

*Primary Examiner* — Theresa Trieu
(74) *Attorney, Agent, or Firm* — Harness, Dickey & Pierce, P.L.C.

(57) ABSTRACT

A floating seal has a lower plate, an upper plate and a pair of seals disposed between the two plates. The lower plate, the upper plate or both plates include a backer which projects outward from the plate to engage one or both of the seals to support the seal during operation.

19 Claims, 3 Drawing Sheets

SCROLL MACHINE USING FLOATING SEAL WITH BACKER

FIELD

The present invention relates to floating seal designs for the axially movable scroll member of a scroll machine. More particularly, the present invention relates to a unique floating seal design for the axially movable non-orbiting scroll member of the scroll machine.

BACKGROUND AND SUMMARY

The statements in this section merely provide background information related to the present disclosure and may not constitute prior art.

A class of machines exists in the art generally known as "scroll" machines for the displacement of various types of fluids. Such machines may be configured as an expander, a displacement engine, a pump, a compressor, etc., and the features of the present invention are applicable to any one of these machines. For purposes of illustration, however, the disclosed embodiments are in the form of a hermetic refrigerant compressor.

Scroll-type apparatus have been recognized as having distinct advantages. For example, scroll machines have high isentropic and volumetric efficiency, and hence are small and lightweight for a given capacity. They are quieter and more vibration free than many compressors because they do not use large reciprocating parts (e.g. pistons, connecting rods, etc.). All fluid flow is in one direction with simultaneous compression in plural opposed pockets which results in less pressure-created vibrations. Such machines also tend to have high reliability and durability because of the relatively few moving parts utilized, the relatively low velocity of movement between the scrolls, and an inherent forgiveness to fluid contamination.

Generally speaking, a scroll machine comprises two spiral scroll wraps of similar configuration, each mounted on a separate end plate to define a scroll member. The two scroll members are interfitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation; i.e., the motion is purely curvilinear translation (i.e., no rotation of any line in the body). The relative rotation between the scroll members is typically prohibited by the use of an Oldham coupling.

The moving fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In a compressor, the second zone is at a higher pressure than the first zone and is physically located centrally in the machine, the first zone being located at the outer periphery of the machine.

Two types of contacts define the fluid pockets formed between the scroll members, axially extending tangential line contacts between the spiral faces or flanks of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts.

One of the difficult areas of design in a scroll-type machine concerns the technique used to achieve tip sealing under all operating conditions, and also at all speeds in a variable speed machine. Conventionally, this has been accomplished by (1) using extremely accurate and very expensive machining techniques, (2) providing the wrap tips with spiral tip seals, which, unfortunately, are hard to assemble and often unreliable, or (3) applying an axially restoring force by axial biasing the orbiting scroll or the non-orbiting scroll towards the opposing scroll using compressed working fluid.

The utilization of an axial restoring force first requires one of the two scroll members to be mounted for axial movement with respect to the other scroll member. This can be accomplished by securing the non-orbiting scroll member to a main bearing housing by means of a plurality of bolts and a plurality of sleeve guides as disclosed in Assignee's U.S. Pat. No. 5,407,335, the disclosure of which is hereby incorporated herein by reference. Second, a biasing load needs to be applied to the axially movable non-orbiting scroll to urge the non-orbiting scroll into engagement with the orbiting scroll. This can be accomplished by forming a chamber on the side of the non-orbiting scroll opposite to the orbiting scroll member, placing a floating seal in the chamber and then supplying a pressurized fluid to this chamber. The source of the pressurized fluid can be the scroll compressor itself. This type of biasing system is also disclosed in the aforementioned U.S. Pat. No. 5,407,335.

The prior art floating seal is an assembly of two metal plates and one or more polymer seals. The lower plate is an as-cast aluminum part with vertical posts that fit through holes in the upper cast iron plate. The upper plate has a feature incorporated into its top surface that acts as a face seal with a muffler plate whenever the two components are in contact. The polymer seals are located by and held between the two plates. The assembly process for the prior art floating seal involves stacking the pieces together and then plastically deforming the aluminum posts such that the top ends locally spread out over the iron plate to form a rigid attachment.

When assembled, the one or more polymer seals are retained by the two plates in a first plane and the sealing interface with the non-orbiting scroll member occurs along a surface of the non-orbiting scroll member that is generally perpendicular to the plane of retention by the two plates. Thus, the one or more polymer seals bend through an approximately ninety-degree angle to achieve their sealing.

The present invention provides the art with an improved seal design by providing a backer or backing plate which supports the polymer seal at the point of bending. The additional support provided by the backer significantly reduces the stresses associated with the seal during operation of the compressor and thus significantly improves the durability of the polymer.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

Figure 1:
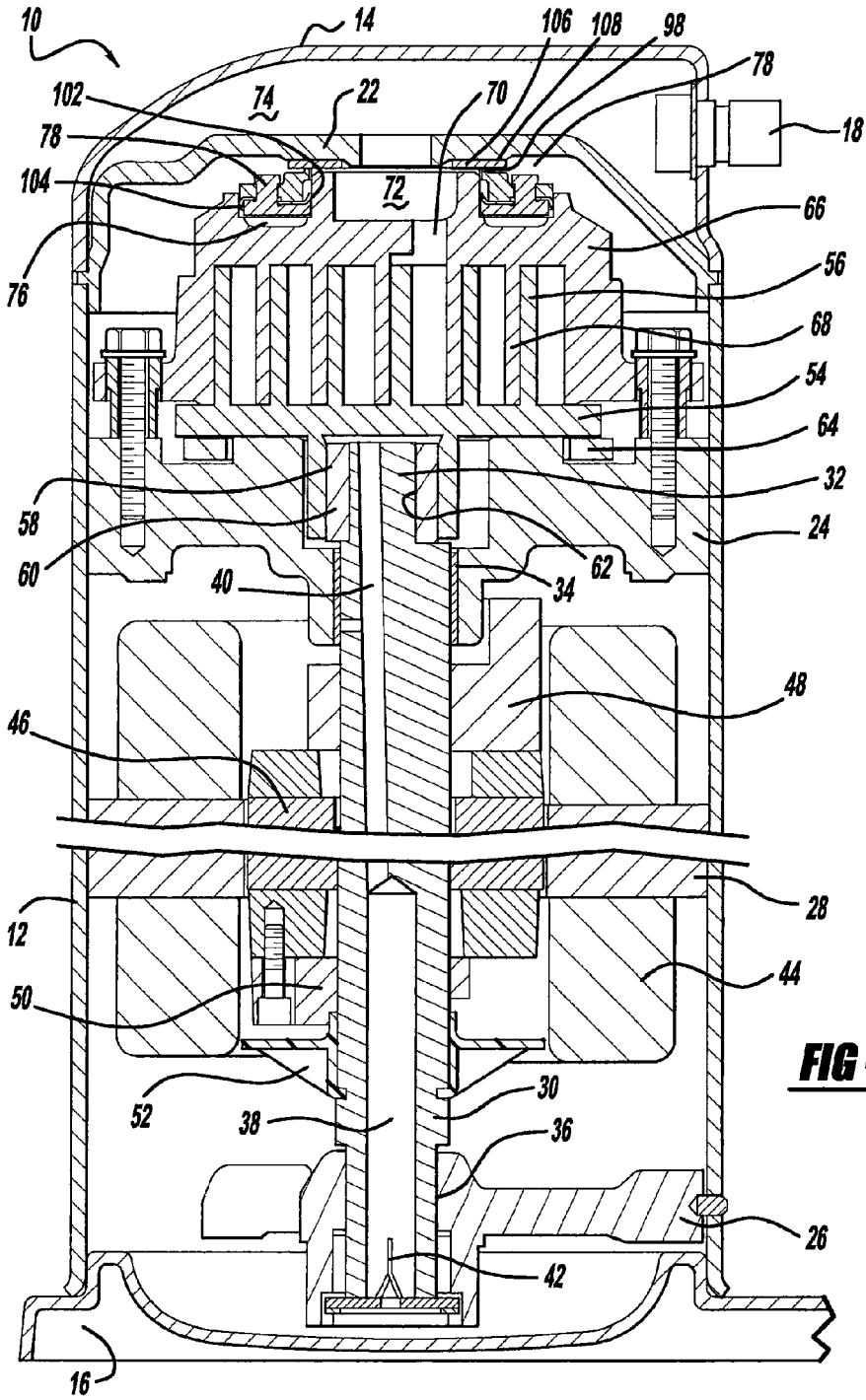
FIG. 1 is a vertical cross-sectional view of a scroll compressor incorporating a floating seal design in accordance with the present invention.

There is illustrated in FIG. 1 a scroll compressor which incorporates a floating seal arrangement in accordance with the present invention and which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a stationary main bearing housing or body 24 which is suitably secured to shell 12, and a lower bearing housing 26 also having a plurality of radially outwardly extending legs, each of which is also suitably secured to shell 12. A motor stator 28, which is generally square in cross-section but with the corners rounded off, is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 is filled with lubricating oil, and bore 38 acts as a pump to pump lubricating fluid up the crankshaft 30 and into bore 40, and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor," the disclosure of which is hereby incorporated herein by reference.

The upper surface of main bearing housing 24 is provided with a flat thrust bearing surface on which is disposed an orbiting scroll member 54 having the usual spiral vane or wrap 56 on the upper surface thereof. Projecting downwardly from the lower surface of orbiting scroll member 54 is a cylindrical hub 58 having a journal bearing therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll member 54 and a non-orbiting scroll member 66 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506 entitled "Oldham Coupling For Scroll Compressor", the disclosure of which is hereby incorporated herein by reference, may be used in place thereof.

Non-orbiting scroll member 66 is also provided having a wrap 68 positioned in meshing engagement with wrap 56 of orbiting scroll member 54. Non-orbiting scroll member 66 has a centrally disposed discharge passage 70 communicating with an upwardly open recess 72 which is in fluid communication with a discharge muffler chamber 74 defined by cap 14 and partition 22 through an opening defined by partition 22. An annular recess 76 is also formed in non-orbiting scroll member 66 within which is disposed a floating seal assembly 78. Recesses 72 and 76 and floating seal assembly 78 cooperate to define axial pressure biasing chambers which receive pressurized fluid being compressed by wraps 56 and 68 so as to exert an axial biasing force on non-orbiting scroll member 66 to thereby urge the tips of respective wraps 56, 68 into sealing engagement with the opposed end plate surfaces.

Figure 2:
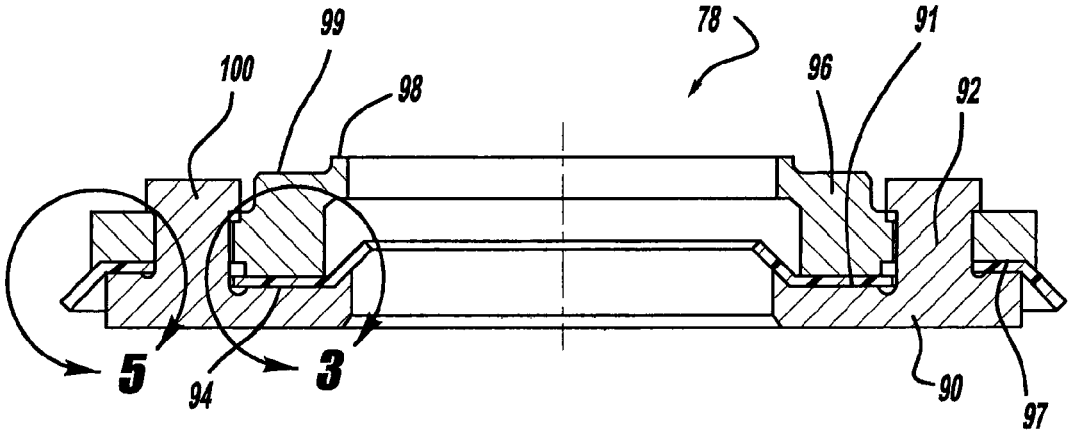
FIG. 2 is an enlarged view of the floating seal illustrated in FIG. 1.
Figure 3:
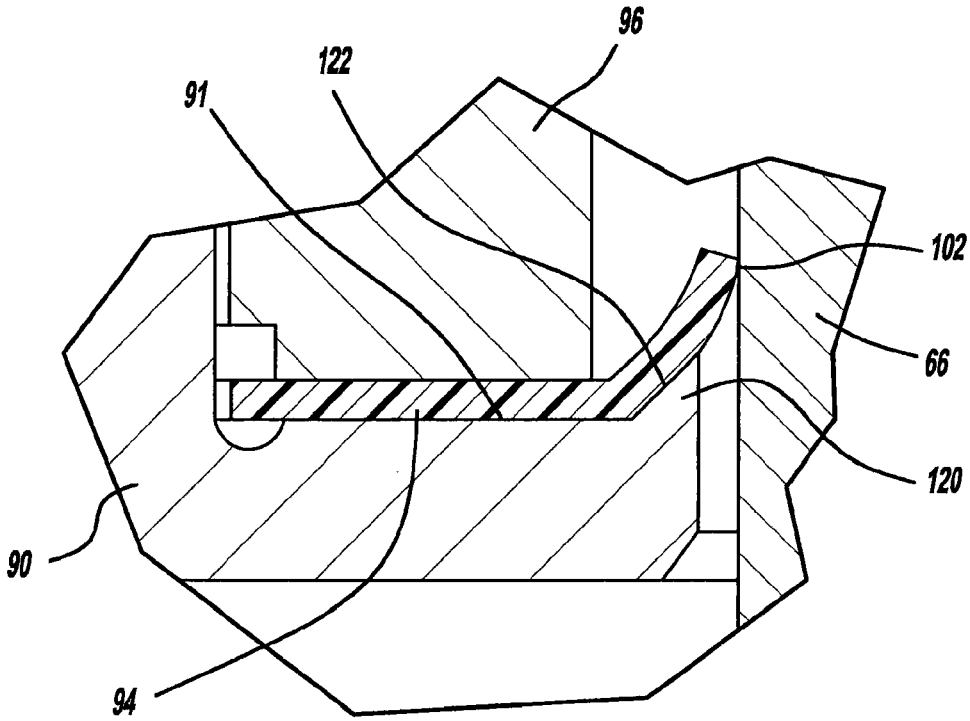
FIG. 3 is an enlarged view of circle 3 in FIG. 2 illustrating a seal in accordance with the present invention.
Figure 4:
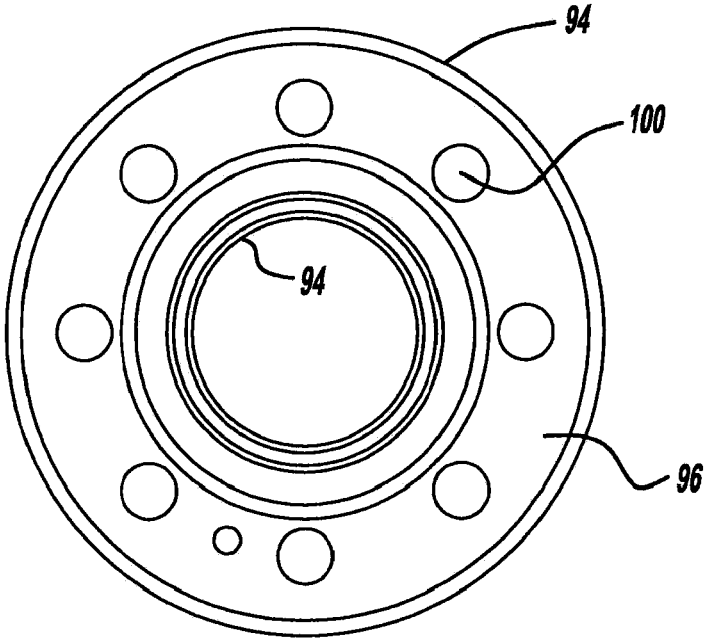
FIG. 4 is a plan view of the floating seal illustrated in FIGS. 1 and 2.

With reference to FIGS. 1-3, floating seal assembly 78 is of a coaxial sandwiched construction and comprises an annular base plate 90 formed out of aluminum or the like. Annular base plate 90 has a laterally extending upper surface 91 having a plurality of equally spaced upstanding annular projections 92 extending therefrom. Disposed on upper surface 91 of base plate 90 is an annular gasket or seal 94 having a plurality of equally spaced holes which receive projections 92. On top of seal 94 is disposed an annular upper seal plate 96 having a plurality of equally spaced holes receiving projections 92. Upper annular seal plate 96, which may be formed of grey cast iron, has a laterally extending lower surface 97 and a laterally extending upper surface 99 including an upwardly projecting planar seal lip 98 disposed about the periphery thereof. The assembly is secured together by swaging the ends of each projection 92 as indicated at 100.

The overall seal assembly therefore provides three distinct seals, namely, an inside diameter seal at 102, an outside diameter seal at 104 and a top seal at 106. Seal 102 isolates fluid under intermediate pressure in the bottom of recess 76 from the fluid under discharge pressure in recess 72. Seal 104 isolates fluid under intermediate pressure in the bottom of recess 76 from fluid at suction pressure within shell 12. Seal 106 isolates fluid at suction pressure within shell 12 from fluid at discharge pressure across the top of floating seal assembly 78. FIG. 1 illustrates a wear ring 108 attached to partition 22 which provides seal 106 between plate 96 and wear ring 108. In lieu of wear ring 108, the lower surface of partition 22 can be locally hardened by nitriding, carbo-nitriding or other hardening processes known in the art.

The diameter of seal 106 is chosen so that there is a positive upward sealing force on floating seal assembly 78 under normal operating conditions i.e. at normal pressure ratios. Therefore, when excessive pressure ratios are encountered, floating seal assembly 78 will be forced downwardly by discharge pressure, thereby permitting a leak of high side discharge pressure gas directly across the top of floating seal assembly 78 to a zone of low side suction gas. If this leakage is great enough, the resultant loss of flow of motor cooling suction gas (aggravated by the excessive temperature of the leaking discharge gas) will cause a motor protector (not shown) to trip, thereby de-energizing the motor. The width of seal 106 is chosen so that the unit pressure on the seal itself (i.e. between sealing lip 98 and wear ring 108) is greater than normally encountered discharge pressure, thus insuring consistent sealing.

The wearing of seal 94 has always been an issue which needed to be addressed. The discharge pressure of compressor 10 urges the inner lip seal portion of seal 94 into engagement with non-orbiting scroll member 66 to form the inside diameter seal at 102. When the inner lip seal portion of seal 94 is left unsupported, the wear of seal 94 increases at the bottom due to creep.

Annular base plate 90 includes a first protrusion, such as an upwardly projecting backer 120 extending longitudinally outwardly away from non-orbiting scroll member 66 from upper surface 91 at a radially inner portion of annular base plate 90. Backer 120 generally supports the side of seal 94 that is opposite to discharge pressure. As shown in FIG. 3, backer 120 defines a contoured surface 122 which mates with the bottom of seal 94 to support seal 94 during operation of compressor 10. While FIG. 3 illustrates backer 120 as being an annular triangled cross-section backer, other configurations of backer 120 can be used if needed to adequately support seal 94.

The intermediate pressure within recess 76 urges the outer lip seal portion of seal 94 into engagement with non-orbiting scroll member 66 to form the outside diameter seal at 104. When the outer lip seal portion of seal 94 is left unsupported, the wear of seal 94 may increase.

Figure 5:
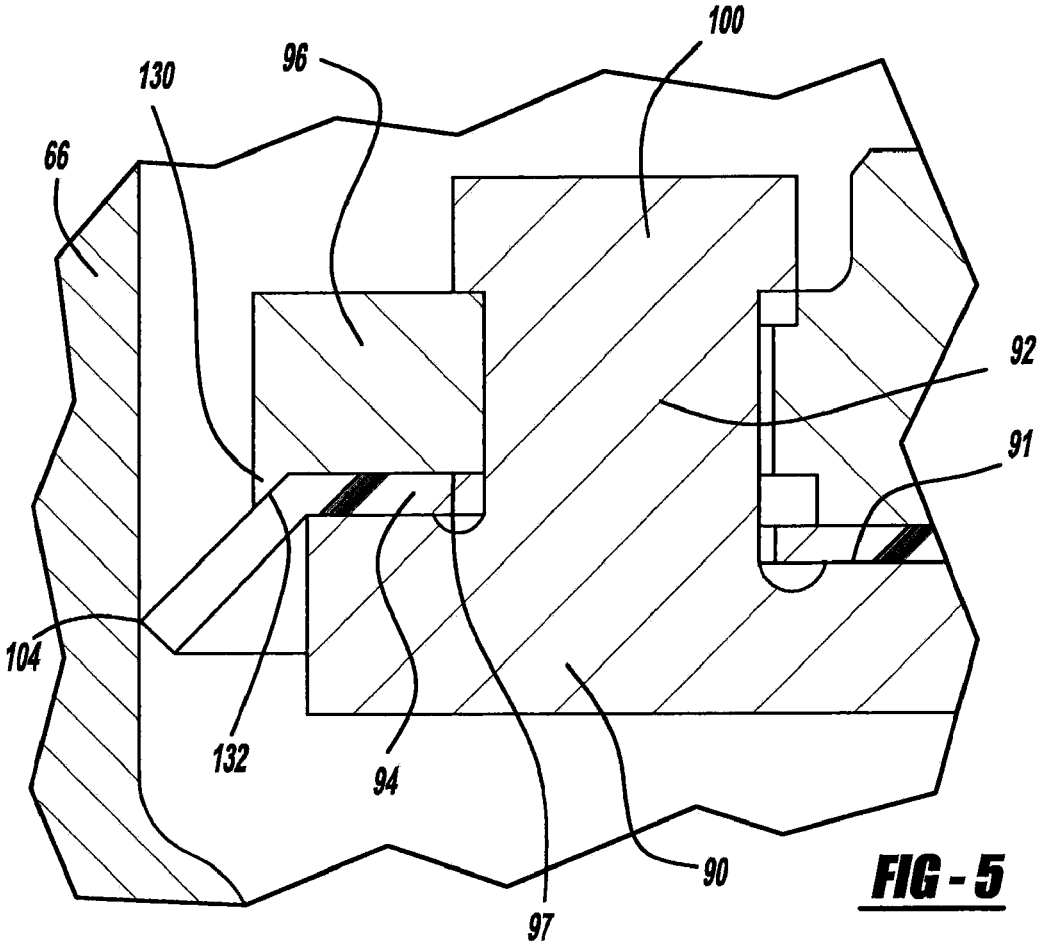
FIG. 5 is an enlarged view of circle 5 in FIG. 2 illustrating a seal in accordance with the present invention.

Upper annular seal plate 96 includes a second protrusion, such as a downward projecting backer 130 extending longitudinally inwardly toward non-orbiting scroll member 66 from lower surface 97 at a radially outer portion of upper annular seal plate 96. Backer 130 generally supports the side of seal 94 that is opposite to intermediate pressure within recess 76. As shown in FIG. 5, backer 130 defines a contoured surface 132 which mates with the top side of seal 94 to support seal 94 during operation of compressor 10. While FIG. 5 illustrates backer 130 as being an annular triangled cross-section backer, other configurations of backer 130 can be used to adequately support seal 94.

What is claimed is:

1. A scroll machine comprising:

a first scroll member having a first spiral wrap extending from a first end plate;

a second scroll member having a second spiral wrap extending from a second end plate, the spiral wraps being intermeshed with one another so that as the scroll members orbit with respect to one another, moving pockets of changing volume are formed by the spiral wraps, the moving pockets moving between a suction pressure zone at a suction pressure and a discharge pressure zone at a discharge pressure;

a cavity defined by the first scroll member;

a seal assembly disposed within the cavity, the seal assembly comprising:

a first plate;

a second plate attached to the first plate;

a seal disposed between the first and second plates and including first and second sealing portions engaging the first scroll member; and a first protrusion extending from a surface of one of the first and second plates, the first protrusion engaging one of the first and second sealing portions, wherein the first protrusion includes a generally triangular cross-section projecting from the first plate and engaging the first sealing portion.

2. The scroll machine according to claim 1, wherein the first protrusion extends from the surface of the first plate to engage the first sealing portion.

3. The scroll machine according to claim 2, wherein the first sealing portion isolates the cavity from the discharge pressure in the discharge pressure zone.

4. The scroll machine according to claim 2, further comprising a second protrusion extending from a surface of the second plate to engage the second sealing portion.

5. The scroll machine according to claim 4, wherein the second sealing portion isolates the cavity from the suction pressure in the suction pressure zone.

6. The scroll machine according to claim 5, wherein the first sealing portion isolates the cavity from the discharge pressure in the discharge pressure zone.

7. The scroll machine according to claim 1, wherein the first sealing portion isolates the cavity from the discharge pressure in the discharge pressure zone.

8. The scroll machine according to claim 1, further comprising a second protrusion extending from a surface of the second plate to engage the second sealing portion.

9. The scroll machine according to claim 8, wherein the second protrusion is an annular projection having a generally triangular cross-section projecting from the second plate.

10. The scroll machine according to claim 9, wherein the second sealing member isolates the cavity from the suction pressure in the suction pressure zone.

11. The scroll machine according to claim 10, wherein the first sealing member isolates the cavity from the discharge pressure in the discharge pressure zone.

12. A compressor comprising:

a housing defining a discharge passage;

a compression mechanism supported within said housing and including first and second scroll members meshingly engaged with one another and forming a series of compression pockets, said first scroll member including a discharge passage extending therethrough; and a seal assembly sealingly engaged with said compression mechanism and said housing to define a sealed discharge passage between said discharge passage in said housing and said first scroll member, said seal assembly including a first annular plate and an annular seal member, said first annular plate having a first laterally extending surface including a first protrusion extending longitudinally from one of a radially outer and a radially inner portion of said first laterally extending surface, said annular seal member being supported on said laterally extending surface and said first protrusion.

13. The compressor of claim 12, wherein said first protrusion extends generally outwardly from said first scroll member.

14. The compressor of claim 13, wherein said first protrusion extends from a radially inner portion of said first laterally extending surface.

15. The compressor of claim 12, wherein said first protrusion extends generally inwardly toward said first scroll member.

16. The compressor of claim 15, wherein said first protrusion extends from a radially outer portion of said first laterally extending surface.

17. The compressor of claim 12, wherein said seal assembly is sealingly engaged with said first scroll member to define a fluid chamber operating at an intermediate fluid pressure between a suction pressure and a discharge pressure, said seal assembly isolating said fluid chamber from the suction pressure and the discharge pressure.

18. The compressor of claim 12, wherein said seal assembly includes a second annular plate including a second laterally extending surface and a second protrusion extending longitudinally from a radially outer portion of said laterally extending surface, said first protrusion extending from a radially inner portion of said first laterally extending surface, said annular seal being disposed between said first and second annular plates and being supported on said second laterally extending surface and said second protrusion.

19. The compressor of claim 12, wherein said first protrusion extends longitudinally outwardly relative to said first scroll member and said second protrusion extends longitudinally inwardly relative to said first scroll member.

* * * * *